United States Patent [19]

Seminario

[11] 3,952,394

[45] Apr. 27, 1976

[54] VALVE CORE EXTRACTION TOOL

[76] Inventor: Ezekiel Seminario, 15500 Tustin Village Way, Tustin, Calif. 92680

[22] Filed: Oct. 4, 1974

[21] Appl. No.: 512,171

[52] U.S. Cl. ..... 29/263; 29/282

[51] Int. Cl.[2] ..... B25P 19/04

[58] Field of Search ..... 29/213, 258, 263, 265, 29/280, 281, 282

[56] References Cited

UNITED STATES PATENTS

| | | | |
|---|---|---|---|
| 2,233,232 | 2/1941 | Wilkinson | 29/282 |
| 2,562,419 | 7/1951 | Ferris | 29/264 |
| 2,649,825 | 8/1953 | Fisher | 29/213 |
| 3,096,574 | 7/1963 | Hillberg | 29/263 |

*Primary Examiner*—James L. Jones, Jr.
*Attorney, Agent, or Firm*—Grover A. Frater

[57] ABSTRACT

Removal of cartridges or cores and sleeves from valve bodies is facilitated with a tool having a threaded rod extending through a base and through a spacer which is rotatable relative to the rod and to the base. The rod is provided with a means at its end, at the side of the base toward the spacer by which the tool may be attached to the core of a valve. Rotation of the base relative to the rod draws the valve core up into the spacer whose end is placed in abutment with the valve body. The sleeve part of the valve cartridge is removed with the aid of a tube which is carried by the base and extends therefrom so that its axis is substantially parallel with the axis of the threaded rod. The end of the tube away from the base is split along its length from the end of the tube so that the tube is divided into segments which may be spread apart. A tapered rod disposed in the tube has a threaded part by which it can be drawn into the tube so that an enlarged end of the rod forces the segments of the tube to larger diameter. Using the base, the tube is withdrawn from the valve body.

12 Claims, 3 Drawing Figures

FIG. 2

VALVE CORE EXTRACTION TOOL

This invention relates to improvements in tools for dissembling valves of a type called "spool valves." It relates particularly to tools for extracting cores and sleeves from valve bodies.

A spool valve is one in which the moving element is a rod formed with lands and grooves and is called a spool. It is fitted within a cylindrical cavity of a valve body. The body is formed with a number of ports that open to the cylindrical cavity and the flow of fluid from and to and between those ports is controlled by axial movement of the spool. In one refinement, a cylindrical sleeve is interposed between the spool and the valve body, and the sleeve is movable relative to the spool and to the valve body.

Specific forms of this general kind of construction are widely used in the hydraulic control field. They are also used in valves for domestic water systems, particularly in mixing valves.

A mixing valve, in the domestic water field, is one that will mix hot and cold water in any desired proportion and which will also control the total volume of flow. A number of commercially available mixing valves employ a single control element. One such valve is sold under the brand name "MOEN." The MOEN mixing valve uses a single control handle which is twisted to change the ratio of hot to cold water. The handle is translated along the rotational axis to change the total volume of flow. Twisting rotates a sleeve to change the ratio of hot to cold flow. Translating the handle translates the core and alters total flow rate.

The invention is applicable to spool valves generally, and it is applicable particularly to valves that involve both a sleeve and a spool or core such as the Moen valve. The Moen valve is mentioned here because it has had wide acceptance. The embodiment selected for illustration in the accompanying drawing is designed specifically for use in extracting the cartridges from Moen valves. For the purpose of this application, a cartridge is defined as the combination of the spool, or core, and its sleeve. The sleeve of a Moen valve is provided with lands and grooves by the addition of resilient O rings which are disposed in circumferential grooves in the outer surface of the sleeve. Instead of lying in a plane perpendicular to the axis of the sleeve, one of those O rings lies in a plane that intersects the sleeve axis at an angle of approximately 45 degrees. A pair of ports that extend through the sleeve from opposite sides line one on side of that O ring and the other on the side. As a consequence of that feature, which is not part of this invention, rotation of the sleeve controls mixing. Axial movement of the center core controls flow rate. One Moen cartridge is identified as Cartridge Assembly, Part No. 1200.

Under certain conditions of water composition and water temperature, portions of the surfaces of valve cores and sleeves may become corroded, or encrusted with the mineral deposits, or both. When that happens, the valve may leak and the force required to operate it may change. Whether that condition is to be remedied by repairing or replacing the cartridge, it is required that the cartridge be removed from the valve body. If the bore in which the cartridge is disposed is a through opening, the cartridge may usually be removed easily by simply pushing it out. However, in the case of some valves, and in the case of the Moen valve, the cartridge is disposed in a cylindrical bore, the bottom end of which is closed, so that the cartridge can be removed only by pulling it from the bore. Pulling may be a difficult task because of difficulty in securing a pulling tool to the cartridge. Since the core has smaller diameter than the valve body bore, securing a tool to it is usually less difficult than is the task of securing a tool to the sleeve. However, securing a pulling tool to the core and pulling on that may or may not result in removal of the sleeve. It may be that the core is removed without the sleeve, and in that case, the repairman is left with what has often been a very difficult task to remove the sleeve.

It is an object of this invention to provide an improved tool for use in repairing valves of the kind that employ cartridge consisting of a sleeve and a spool or core. It is an object to provide a tool that will permit easy removal of the spool and of the sleeve. In this connection, it is an object to provide a tool which will remove the core and the sleeve together, but failing that, can remove the core and the sleeve separately.

One of the specific objects of the invention is to provide an improved tool for use in removing the core or cartridge of Moen mixing valves.

These, and other objects and advantages of the invention which will hereinafter appear, are realized in part by the provision of a tool having a base through which a threaded rod extends and has threaded engagement. One end of the rod is fitted with means by which it may be secured to the cartridge of a valve, and specifically by which it may be secured to the core if the cartridge comprises both a core and a sleeve. A spacer is mounted over the rod so that one end of it bears against the base, and so that the other end of the spacer may be placed in abutment with the body of the valve. Relative rotation of the rod and the base results in drawing the core from the valve. For removal of the sleeve, in the event that the sleeve is not removed with the core, the invention provides a base upon which an expandable member is mounted. That expandable member extends from the base and is fixed against rotation relative to the base. It is arranged so that it can be inserted into the valve sleeve. The tool includes a means by which the expansible member may be expanded to that it engages the inner surface of the sleeve. The expansible member having been expanded, it, and therefore the sleeve, can be rotated relative to the valve body by rotation of the base. Having been rotated to break any seal between the sleeve and the valve body occasioned by corrosive action or the deposition of mineral material, the base and the expansible member together can be used to apply pulling force to withdraw the sleeve from the valve body. To this end the base is arranged so that it can serve as a handle and as a lever. The expansible member, too, is arranged so that it can serve as a handle for exerting a pulling force.

In the preferred embodiment of the invention, the tool elements that are employed for core removal are combined with the tool elements that are specific to sleeve removal in a way that makes the tool for one function serve as a portion of the tool having primarily the other function. Thus, the expansible member serves as a crank for the core or spool extraction tool, whereas the base, which forms a part of the core or spool extraction tool, serves as a lever system for the rotation of the expansible element used to remove sleeves.

Figure 1:
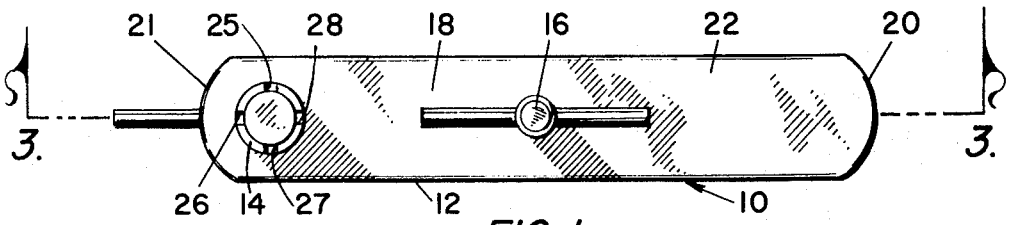
FIG. 1 is a top plan view of an extraction tool which embodies the invention.
Figure 2:
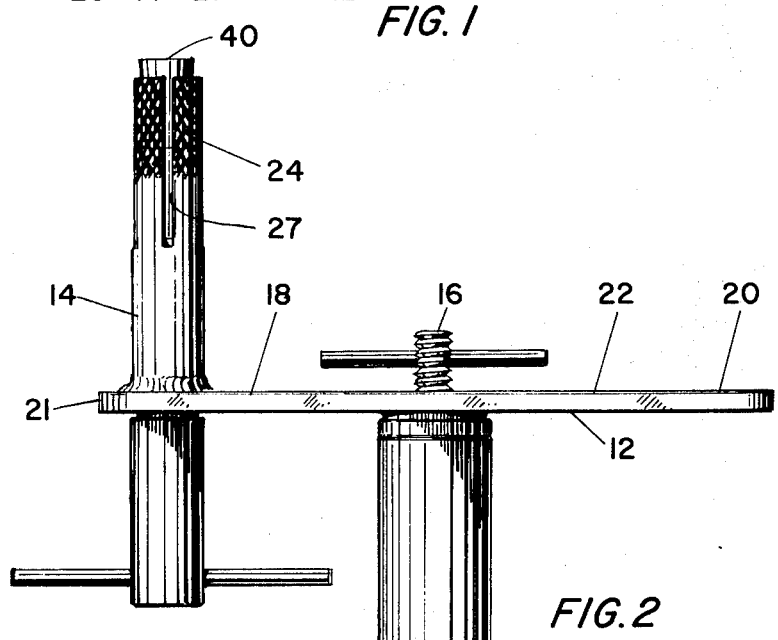
FIG. 2 is a view in front elevation of the tool shown in FIG. 1.

The tool in FIG. 1 includes elements that do two different tasks. In that sense, the tool shown in the drawings is a "combination" tool. However, the parts that are intended primarily for use in accomplishing one task form part of the tool for performing the other task. That is true in the case of both tasks. Accordingly, the structure shown in the drawings is a single tool that performs two tasks.

The primary task of the tool is to remove cartridges from valve bodies by pulling on the spool or core portion of the cartridge. Pulling on the core can be expected to result in extraction of the entire cartridge. In the case of the Moen valve, that means that the core and the sleeve are extracted together. However, it is possible that a greater force would be required to remove the sleeve from the valve body than is required to remove the core from the sleeve. In that case, operation of the tool will ordinarily result only in removal of the core, leaving the sleeve in the valve body. However, using the same tool in somewhat different fashion, makes it possible to remove the sleeve separately.

In FIG. 1, the tool is identified generally by the reference numeral 10. It includes as one of its parts a structure which has the form of an elongated bar 12. A tube 14 is carried by the bar at one end 21 and a threaded rod 16 is carried by the bar at an intermediate point along its length. That portion of the bar 12 which carries the tube 14 and the rod 16 and spans the space between them, is called the base of the tube and it is identified by the reference numeral 18. That portion of the bar which extends from the region of threaded rod 16 to the other end 20 of the bar, is identified by the reference numeral 22 and it is sometimes referred to as a lever.

End of tube 14 is divided into four segments. The end of the tube is cut or split down over a portion of the length of the tube, approximately halfway in this embodiment, and the outer surface of those segments is serrated or knurled as indicated by the reference numeral 24. For identification, the four slits, or slots, are designated 25, 26, 27 and 28.

The tube 14 is to serve as an expansible means for insertion into a sleeve that is to be removed from a valve body. The tube is associated with an expansion means which drives the segments of the tube outwardly to a larger diameter so that the knurling 24 engages the inner surface of the sleeve tightly. The sleeve can be forced to rotate relative to the valve body by rotating the expansible member, here tube 14. For that purpose, the end of the tube 14 away from the slits is fixed to the end 21 of bar 12 by any convenient means. In this example, the tube is welded to the bar 12 so that the bar can be used as a lever to twist the tube about its central axis.

Figure 3:
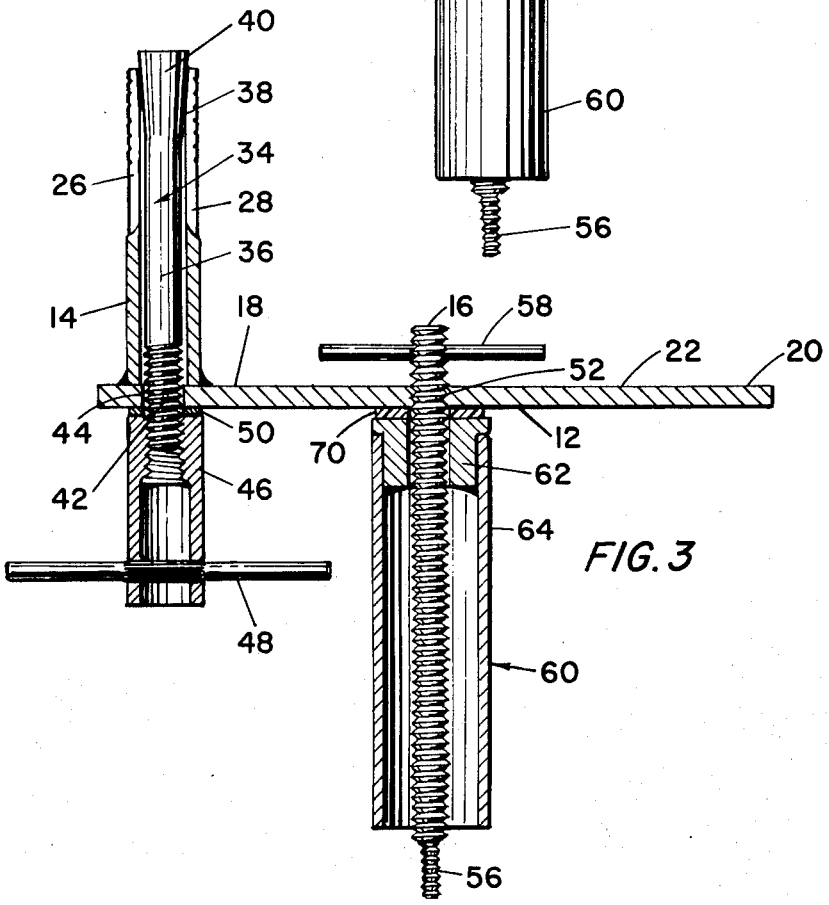
FIG. 3 is a cross-sectional view of the tool taken on line 3—3 of FIG. 1.

The expanding means may have a variety of forms. The preferred form is shown in FIG. 3 where it comprises an expanding rod which is disposed in the tube 28. The rod, which is generally identified by the reference numeral 34, tapers to a larger diameter at its upper end. The body or shank 36 of the expanding rod has a diameter less than the inside diameter of the sleeve 14, but at its upper end it is tapered to a diameter which exceeds the inside diameter of tube 14. In this embodiment, the inner, upper end of the tube 14, or of the segments that remain after the tube is slit, is tapered slightly in the region identified by the reference numeral 38. It is tapered to a larger inside diameter toward the upper end of the tube and the degree of taper corresponds substantially to the degree of taper of the tapered end 40 of the rod 34. When rod 34 is translated downwardly in FIG. 3, the tapered portion 40 is forced into the end of the tube in greater degree and the segments of the tube are cammed or forced outwardly so that they define a greater diameter. The tube has an outside diameter in relaxed condition almost equal to the inside diameter of the valve sleeve.

Some means is provided for translating the expansion rod 34 relative to the tube 14. In this embodiment, that means comprises forming the opposite end 42 of the expansion rod 34 with external threads. The bar 12 is formed with an opening the axis of which is substantially coincident with the axis of the tube 14. The threaded end 42 of rod 34 extends through that opening 44 where it is engaged by the threads of a nut 46. In preferred form, that nut is cylindrical and is provided at its end away from bar 12 with a cross handle 48 by which it may be rotated relative to the rod 34. Frictional engagement of the tapered end 40 with the end of the tube 14 tends to prevent the expansion rod 34 from rotating relative to the tube. Accordingly, rotating the nut 46 operates to translate the expansion rod and pull it more tightly into the tube. To reduce the frictional force between the nut 46 and the bar 12, a washer 50, which surrounds the rod, is interposed between the nut and the bar.

The threaded rod 16 is disposed in, and has threaded engagement with, the threads of a threaded opening 52 which is formed at an intermediate point between the ends 20 and 21 of the bar 12. In this embodiment, that threaded hole 52 is formed substantially midway between the two ends. A rod 16 is threaded into that opening and it extends so that its axis is substantially parallel with the axis of the tube 14 and the expansion rod 34. One end of the threaded rod 16 is provided with a connecting means for connecting the threaded rod to the valve core to be removed. In this embodiment, that connecting means is made to connect to the end of the core of a Moen brand valve. The Moen core is formed with a threaded opening in its end and in the embodiment shown, the "one end" of the threaded rod 16 is formed with a threaded extension 56 which has size and is threaded so that it can be threadedly engaged into the valve core. Other embodiments would have attaching means suitable for valves with which they were to be connected.

The other end of the rod 16 is advantageously fitted with some means by which the rod 16 may be rotated conveniently to facilitate threading the end 56 into the valve core to be removed. In this case, that means comprises a handle 58 which extends to the other end of threaded rod 16 and is fixed in position. It is preferred as shown, that the handle 48 of nut 46 and the handle 58 of threaded rod 16 lie in parallel planes which are parallel with the bar 12 and perpendicular to the threaded rod and the tube.

It is possible to rotate the threaded rod 16 until it is entirely removed from the bar 12. It could then be turned around and threaded into the opening 52 from the opposite direction so that the end 56 is disposed on the same side of the bar 12 as is the tube 14. The tool is usable, if that is done, but it is less convenient to use. As will be described later, the tube 14 serves as a handle of a crank. If the rod 16 is inserted in the opposite direction in view of some clearance or interference problem, then the nut 46 and handle 48 can serve as the crank handle. The nut 46 is simply backed off of the threaded end 44 of expansion rod and the assembly is pushed so that the tapered end 40 is moved out of engagement with the inner walls of the tube 14. In that condition, the handle 48 and nut 46 can rotate freely and serve as a crank handle for the bar 12. In most cases, however, it is preferred to assemble the tool as shown in the drawings.

The tool also includes a spacer element 60. That element is assembled on the threaded rod 16 and it is interposed between the bar 12 and the body of the valve whose cartridge is to be removed. The spacer does not have threaded connection to rod 16. Instead, it is slidably disposed on that rod. In preferred form, it is a cylindrical member having inside diameter sufficiently great so that the valve cartridge can be telescoped into the interior of the spacer. The upper end of the spacer is fitted with a bushing 62 which is inserted into the upper end of the cylindrical sleeve 64. In preferred form, the central, axial, opening in the bushing is only slightly larger than the outside diameter than the threaded rod 16.

To use the tool in removing a core, the tool assembly is held using the bar 12 or the tube 14, or both, to hold the threaded rod 16 so that end 56 is aligned with the opening in the end of the valve core. When the tool is so aligned the threaded rod 16 is rotated by means of handle 58 so that end 56 is threadedly engaged in the end of the core. That having been done, the bar 12 is rotated relative to the threaded rod 16 by rotating it around the rod. The crank handle 14, or the nut 46 if the assembly is inverted, is used to rotate bar 12. The rotation is accomplished relative to rod 16 in a direction to draw the rod, and therefore the valve core, into the spacer 60. In preferred form that spacer is sufficiently long so that it will accommodate almost the entire length of the core. However, once the core has been partially withdrawn from the valve, the force required to remove it is ordinarily much less. It is usually unnecessary to operate the crank to draw the core entirely into the tube. Instead, the tool user, grasping the bar 12 on both sides of the threaded rod 16, can pull the valve core straight out from the housing.

One of the advantages of the invention is that the rod 12 need not be cranked to withdrawn the threaded rod 16. While that is the preferred mode of operation, if there is interferring plumbing or other apparatus that prevents convenient crank action, rod 16 may be screwed out through the bar 12 by using the handle 58 to rotate the screw. That procedure is much more laborious, but it is an available alternative. If the bar 12 is cranked, then it rotates relative to the valve body. In the preferred form of the invention, the end of the spacer 60 toward the connecting means 56 engages the valve body and does not rotate relative to the body. Instead, the cylindrical sleeve portion 64 of the spacer is used as a handle to keep the rod 16 aligned with the axis of the core to be removed. In that case, the bar 12 rotates relative to the spacer 60. To facilitate that, a washer 70 is provided. The washer is disposed over the threaded rod 16 between the bar 12 and the element 62.

Although I have shown and described certain specific embodiments of my invention, I am fully aware that many modifications thereof are possible. My invention, therefore, is not to be restricted except insofar as is necessitated by the prior art.

I claim:

1. An extraction tool for extracting valve cores and sleeves from valves, comprising in combination:

a base;

expansible means in the form of an expansible member carried by said base for insertion into a valve sleeve;

expanding means carried by said base for expanding said expandable member;

connecting means for completing a connection to a valve core;

a threaded rod having threaded connection to said base at a point removed from said expansible means, said connecting means being fixed to an end of said threaded rod such that said connecting means is moved to change its distance from said base as an incident to rotation of the rod relative to the base on the axis of the rod; and spacer means in the form of a cylinder disposed over said rod with one end abutting said base for engaging a valve body and maintaining said base at a given distance from said valve body whereby rotation of the rod will result in movement of valve core to which said connecting means is connected relative to said valve body.

2. The invention defined in claim 1 in which said spacer means is rotatable about its own axis and the axis of said rod relative to said rod and to said base.

3. The invention defined in claim 1 in which said expansible member extends from said base in a direction substantially parallel to said rod; and crank means for rotating said base relative to said rod to alter the spacing of said base and said connecting member, said crank means comprising said expansible.

4. The invention defined in claim 3 in which said base comprises an elongated bar having said expansible member fixed thereto at a first point along its length and having a threaded opening at a second poing along its length in which said rod is threaded.

5. The invention defined in claim 4 in which said invention further comprises lever means in the form of a lever for imparting twisting motion to said expansible member about an axis extending in the direction of its length, said lever means comprising a length of said bar extending from one of said first and second points in the direction away from the other of said first and second points.

6. The invention defined in claim 5 in which said first point is located at a position near one end of said bar and in which said second point is located at an intermediate point between one end of said bar and the opposite end of said bar.

7. The invention defined in claim 6 in which said expansible member comprising a tube fixed at one end to said bar and being formed with longitudinal slits extending parallel with the axis of the tube from the opposite end of said tube.

8. The invention defined in claim 7 in which said expanding means comprises an expander rod disposed within said tube, having a threaded end extending through an opening in said bar to the side of said bar opposite said tube, said expander rod having means formed at its opposite end for forcing the walls of said tube outwardly as an incident to axial motion of said expander rod; and means in the form of a nut having threaded engagement with the threaded end of said expander rod at said other side of said bar.

9. The invention defined in claim 8 in which said nut is formed with a handle extending in a direction perpendicular to the axis of said nut and in parallel with said bar.

10. The invention defined in claim 9 in which said spacer comprises a cylindrical sleeve having a bushing fixed in one end thereof, the busing being formed with an axial opening to receive said threaded rod;

said invention further comprising a handle fixed to the end of said threaded rod opposite the end to which said connecting member is carried, said handle extending in a direction perpendicular to said threaded rod and to said bar.

11. An extraction tool for removing cartridges from valve bodies comprising:

a bar having a threaded opening formed therethrough at a midpoint along its length;

a threaded rod threadedly engaged in said opening;

connecting means at one end of said rod for attaching said one end of the rod to the end of a valve core;

spacer means having an opening therethrough to receive said rod, said connecting means and a valve core;

said spacer means being disposed over said rod at the side of said bar toward said connecting means and being rotatable relative to said bar and slidable over said rod;

said connecting means comprising a threaded axial extension of said rod;

a handle fixed to the other end of said rod whereby rotation of the rod relative to both said bar and the core to be removed is facilitated;

a crank handle carried by said bar at one end of said bar and extending therefrom in parallel with said rod, said handle comprising a tube having its walls slit over a portion of its length from the end of the tube away from said bar; and expanding means in the form of an expanding rod disposed in said tube and extending through the tube for forcing the slit walls of said tube to greater diameter, said expanding rod being tapered along its length to larger diameter at one of its ends and being threaded at the other of its ends;

said expanding means further comprising means cooperating with said threads for translating the rod relative to the tube such that the tapered part of the expansion rod forces the split walls of said tube outwardly.

12. An extraction tool for removing portions of cartridges from valve bodies, comprising:

a bar;

a tube fixed to said bar and extending from the bar perpendicularily to the direction of its length;

said tube having its walls slit over a portion of its length from the end of the tube away from said bar;

expanding means in the form of an expansion rod disposed in the tube and extending through the tube for forcing the slit walls of the tube to greater diameter, said expansion rod being tapered along its length to larger diameter at one of its end and being threaded at the other of its ends;

said expanding means further comprising means cooperating with the threads of said expansion rod for translating the expansion rod relative to the tube such that the tapered part of the expansion rod forces the split walls of said tube outwardly;

a threaded rod;

a threaded hole at a point of said bar removed from said tube;

the threaded rod being threadedly engaged in said threaded hole and extending therefrom on an axis substantially parallel to the axis of said tube;

connecting means fixed to one end of said threaded rod; and a cylindrical spacer slidably disposed on said threaded rod and having one end abuttable against said bar and rotatable relative to said bar.

* * * * *